US005146195A

United States Patent [19]

Castonguay et al.

[11] Patent Number: 5,146,195

[45] Date of Patent: Sep. 8, 1992

[54] MOLDED CASE CIRCUIT BREAKER WITH LINEAR RESPONSIVE UNIT

[75] Inventors: Roger N. Castonguay, Terryville; David Arnold, Chester, both of Conn.

[73] Assignee: General Electric Company, New York, N.Y.

[21] Appl. No.: 700,820

[22] Filed: May 16, 1991

[51] Int. Cl.[5] ..... H01H 75/12

[52] U.S. Cl. ..... 335/35; 335/21; 335/43

[58] Field of Search ..... 335/6, 35, 20–24, 335/167–176, 43–46

[56] References Cited

U.S. PATENT DOCUMENTS

| | | | |
|---|---|---|---|
| 3,936,780 | 2/1976 | Hennemann | 335/23 |
| 4,503,408 | 3/1985 | Mrenna et al. . | |
| 4,513,268 | 4/1985 | Seymour et al. | 335/35 |
| 4,679,016 | 7/1987 | Ciarcia et al. | 335/132 |

*Primary Examiner*—Lincoln Donovan

*Attorney, Agent, or Firm*—Richard A. Menelly; Fred Jacob

[57] ABSTRACT

A molded case circuit breaker utilizes a thermally responsive trip unit for providing long and short-time overcurrent protection and a magnetically responsive trip unit for instantaneous or short-circuit protection. An electrically and thermally insulative lever interfaces between the thermal element and the circuit breaker trip response bar to linearize the movement of the thermal trip element in response to circuit current.

8 Claims, 2 Drawing Sheets

MOLDED CASE CIRCUIT BREAKER WITH LINEAR RESPONSIVE UNIT

BACKGROUND OF THE INVENTION

U.S. Pat. No. 4,679,016 entitled "Interchangeable Mechanism for Molded Case Circuit Breaker" describes a thermal and magnetic trip unit wherein a pair of separable contacts are held in electric circuit with each other against the opening bias of a pair of powerful operating springs by means of a latch assembly. The circuit breaker becomes unlatched by contact between the trip unit and the pivotally-mounted trip bar to allow the operating springs to drive the contacts to their open position. When such circuit breakers are used within industrial applications, the bi-metal employed within the thermal and magnetic trip unit is designed to generate sufficient trip force to overcome the circuit breaker latch to release the circuit breaker operating springs. In many applications, the bi-metal trip force is inversely proportional to the length of the bi-metal such that the bi-metal must be of sufficient length to provide adequate tripping force. It has been determined, that the distance that the end of the bi-metal becomes displaced is proportional to the second power of the bi-metal length. Other factors that affect the bi-metal displacement and tripping force such as composition and shape must also be taken into consideration in the bi-metal trip unit design. With elongated bi-metals such as described within the aforementioned U.S. Pat. No. 4,679,016, additional space within the circuit breaker housing must be provided to allow for the large transfer distance between the circuit breaker trip bar and the end of the bi-metal. When the ampere-rating of the circuit breaker is increased, a heavier bi-metal trip unit is employed because of the higher currents passing through the bi-metal at the higher ampere-rated circuits. It would be economically beneficial to be able to linearize the bi-metal whereby the transfer distance of the end of the bi-metal varies in direct proportion to the bi-metal length while allowing a single bi-metal geometry to be used over a circle range of ampere-ratings without damage due to overheating at the higher ratings or lack of trip response at the lower ratings.

Accordingly, one purpose of the invention is to provide a thermal and magnetic trip unit wherein the transfer distance of the bi-metal is linearly proportional to the length of the bi-metal while preventing the bi-metal from overheating at higher ampere loadings.

SUMMARY OF THE INVENTION

A thermally and electrically insulative trip lever is interposed between the circuit breaker bi-metal trip unit and the circuit breaker trip bar to cause the bi-metal to move linearly relative to the length of the bi-metal in response to circuit current. The trip lever is co-extensive with the bi-metal and is pivotally arranged at one end in common fulcrum with the bi-metal.

DESCRIPTION OF THE PREFERRED EMBODIMENT

Figure 1:
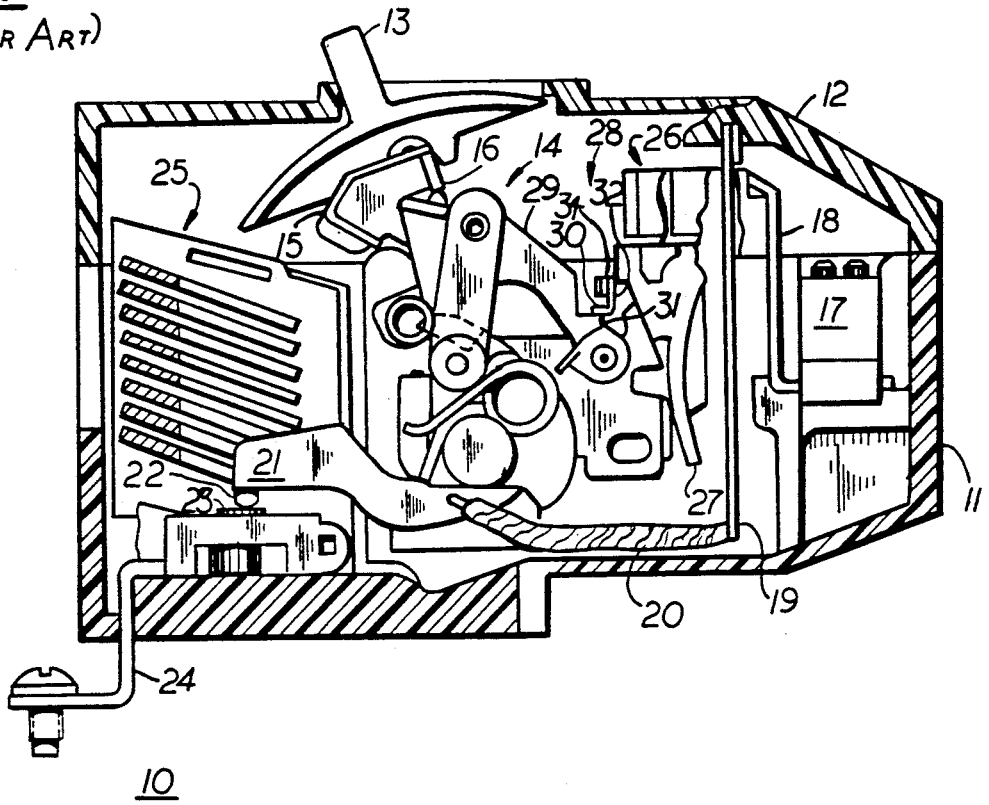
FIG. 1 (PRIOR ART)
FIG. 1 is a side view in partial section of a molded case circuit breaker employing a thermal and magnetic trip unit in accordance with the prior art.

An industrial-rated circuit breaker 10 such as described in the aforementioned U.S. Pat. No. 4,679,016 is depicted in FIG. 1 and consists of a plastic case 11 to which a cover 12 is fixedly secured. The circuit breaker operating handle 13 connects with the circuit breaker operating mechanism 14 by means of the handle yoke 15 to overcenter the operating mechanism springs 16 and move the movable contact arm 21 and attached movable contact 22 in and out of circuit with the fixed contact 23. The circuit breaker operating mechanism is designed to automatically interrupt the circuit current when the circuit current exceeds predetermined current values for predetermined time increments. The circuit current transfers through the load terminal lug 17 which electrically connects with the movable contact arm 21 by means of the flexible braid conductor 20, bi-metal 19 and load terminal conductor 18. The circuit current then transfers through the movable contact arm 21, movable and fixed contacts 22, 23 to the load connector strap 24. The magnetic trip unit 26 arranged at the fixed end of the bi-metal 19 responds to intense overload current through the load conductor 18 to disengage the latch assembly 28 whereas the bi-metal 19 disengages the latch assembly upon the occurrence of sustained long-time and short-time overcurrent conditions. The latch assembly interacts with the cradle 29 which in turn restrains the operating springs 16 from snappingly driving the movable contact arm 21 to the open position in the following manner. The cradle hook 31 engages the primary latch 30 at the bottom of the latch plate 34 while the top part 32 of the latch plate provides a secondary latch function by requiring that the top part of the latch be displaced by the trip bar 27 before allowing the cradle 29 to rotate free from the primary latch surface and allow the operating springs 16 to drive the movable contact arm 21 and attached movable contact 22 out from electric circuit with the fixed contact 23. The arc chute 25 cools and quenches the arc that occurs between the fixed and movable contacts when separated during intense overcurrent conditions.

Figure 2:
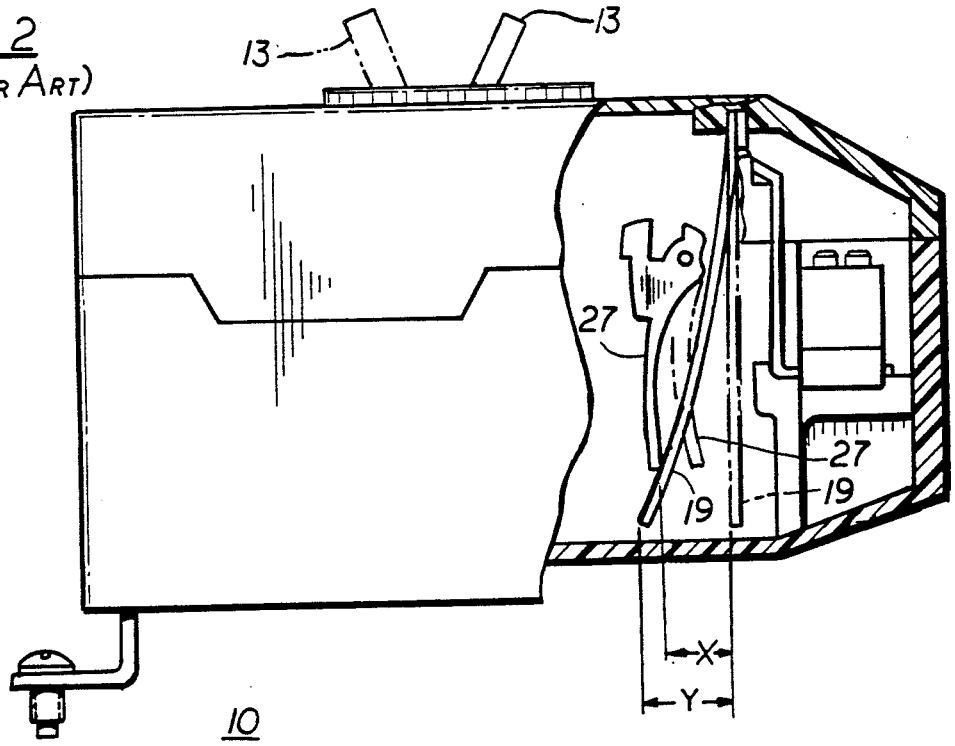
FIG 2 (PRIOR ART)
FIG. 2 is a cut-away side view of the circuit breaker of FIG. 1 detailing the transfer distance of both the bi-metal trip unit and the circuit breaker trip bar.

The response of the bi-metal 19 with respect to the circuit current transferring through the bi-metal is best seen by referring now to FIG. 2 where the circuit breaker 10 is depicted in its TRIPPED position wherein the operating handle 13 depicted in the TRIPPED position in solid lines and in the OFF position in phantom.

The bi-metal 19 and trip bar 27 are depicted in phantom in their quiescent circuit conditions in the absence of overload circuit current. Upon the occurrence of an overcurrent condition, the end of the bi-metal moves to the position indicated in solid lines which represents a total transfer distance Y. The bi-metal moves the trip bar 27 to the TRIPPED position indicated in solid lines. The bi-metal travels into contact with the trip bar 27 over a shorter transfer distance X, as indicated.

Figure 3:
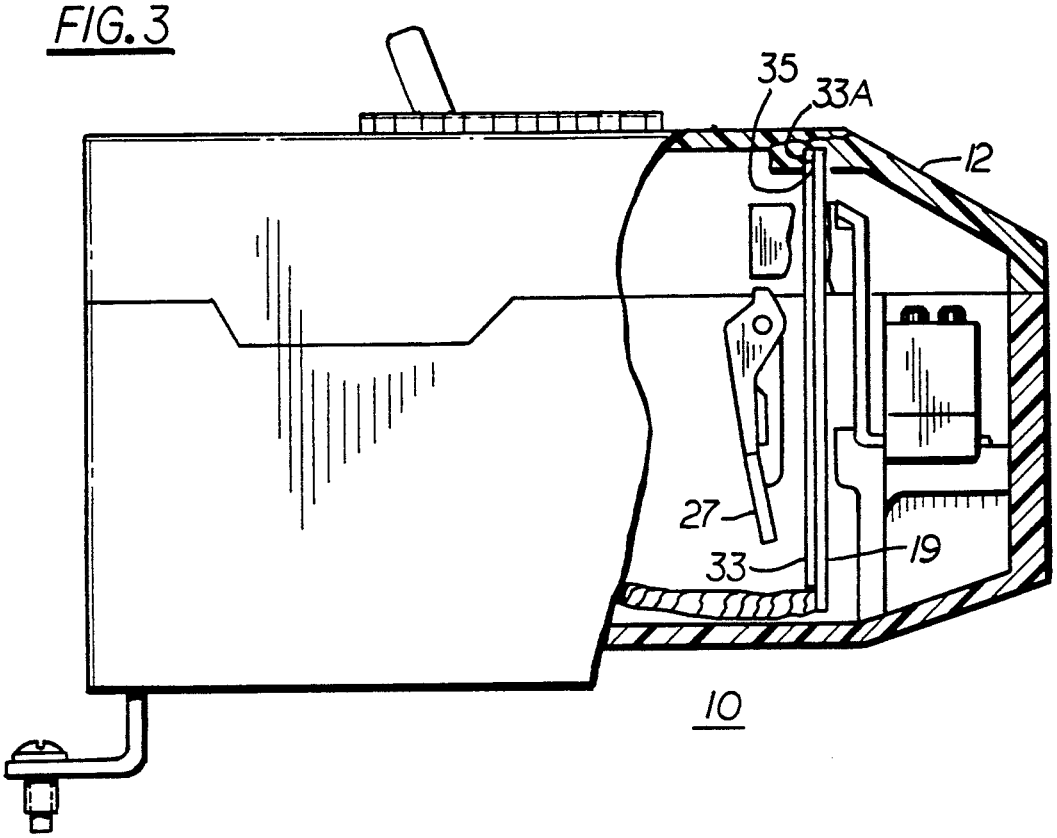
FIG. 3 is a cut-away side view of a thermal and magnetic trip unit containing the electrically and thermally insulative trip lever in accordance with the invention.

In accordance with the invention, the circuit breaker 10 depicted in FIG. 3 includes an electrically and thermally insulative trip lever 33 co-extensive with and in abutment with the bi-metal 19. The trip lever is formed from a glass-filled polyester resin to ensure sufficient stiffness to allow the trip lever 33 to move in consort with the bi-metal 19 when the trip lever is trapped at one end within the slot 35 arranged within the circuit breaker cover 12 as indicated at 33A. When it is desired to use a fixed bi-metal shape and composition over a wider range of circuit breaker ampere ratings, a metal trip lever could be used to linearize the transfer distance of the end of the bi-metal while electrically shunting the current through the bi-metal to protect the bi-metal from overheating. The trip lever 33 is inserted intermediate the trip bar 27 and the bi-metal and accordingly promotes linear movement of the bi-metal in response to circuit current as best seen by comparing the prior art circuit breaker 10 of FIG. 2 to the circuit breaker 10 of FIG. 4.

Figure 4:
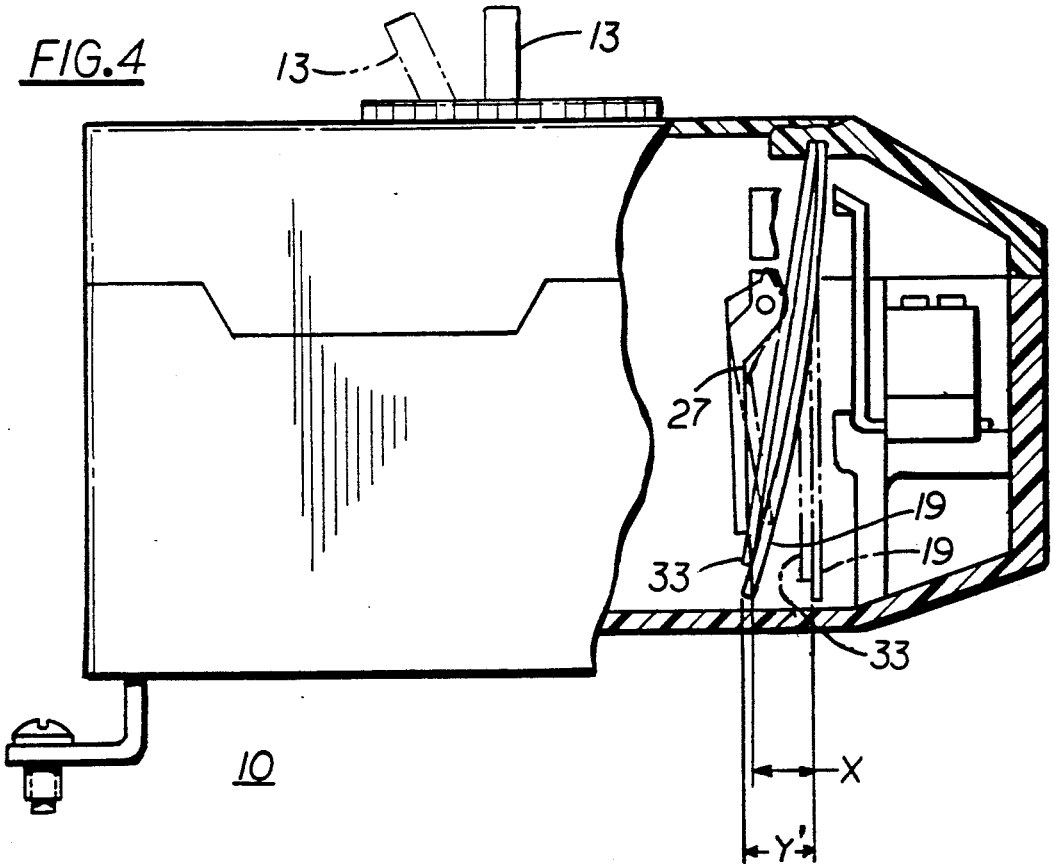
FIG. 4 is a cut-away side view of the circuit breaker of FIG. 3 detailing the transfer distance of both the bi-metal trip unit and the circuit breaker trip bar in accordance with the invention.

With the circuit breaker depicted in FIG. 4, when the circuit breaker operating mechanism has responded to open the circuit breaker contacts and to drive the circuit breaker operating handle 13 from the ON position indicated in phantom to the TRIPPED position indicated in solid lines, the end of the bi-metal 19 has moved a total transfer distance $\underline{Y}'$ from the ON position indicated in phantom to the TRIPPED position indicated in solid lines and the trip lever 33 has moved from the ON position indicated in phantom to that indicated in solid lines. The trip lever travels into contact with the trip bar 27 over a similar transfer distance $\underline{X}'$, as indicated. By comparing the total transfer distance $\underline{Y}$ of the end of the prior art bi-metal arrangement of FIG. 2 to the total transfer distance $\underline{Y}'$ of the end of the trip lever 33, for the same bi-metal shape and composition, it is noted that the total transfer distance is substantially reduced. The improvision of a trip lever between the trip bar and the bi-metal accordingly translates the displacement of the bi-metal from an exponential to a linear response.

Having thus described our invention, what we claim as new and desire to secure by Letters Patent is:

1. A molded case circuit breaker having a linearly responsive trip unit comprising:

a molded plastic case and cover;

a pair of contacts within said case arranged for separation both manually and upon occurrence of an overcurrent condition of predetermined magnitude and duration;

an operating mechanism within said case arranged for automatically separating said contacts, said operating mechanism being restrained from operation by means of a latch assembly;

a trip bar within said case proximate said latch assembly, said trip bar arranged for contacting said latch assembly and releasing said operating mechanism;

a bi-metal within said case proximate said trip bar, said bi-metal responding to circuit current to contact said trip bar and cause said trip bar to contact said latch assembly; and a trip lever intermediate said bi-metal and said trip bar, said bi-metal being fixedly positioned at a first end and free to move at a second end opposite said first end and said trip lever being fixedly positioned at a first end and free to move at a second end opposite said first end, whereby said trip lever becomes driven into contact with said trip bar under the urgence of said bi-metal.

2. The circuit breaker of claim 1 wherein said lever comprises an electrically-insulative material.

3. The circuit breaker of claim 1 wherein said lever comprises a thermally-insulative material.

4. The circuit breaker of claim 1 wherein said trip lever comprises a polyester fiber.

5. The circuit breaker of claim 3 wherein said fiber glass-filled.

6. The circuit breaker of claim 1 wherein said bi-metal is positioned within a slot formed within said cover.

7. The circuit breaker of claim 5 wherein said trip lever is fixedly positioned within said slot.

8. The circuit breaker of claim 1 wherein said lever comprises a metal.

* * * * *